United States Patent [19]

Shin

[11] 4,369,347

[45] Jan. 18, 1983

[54] DAMPER ACTIVATION IN A COMBINED MICROWAVE AND ELECTRIC HEATING OVEN

[75] Inventor: Yasuo Shin, Nara, Japan

[73] Assignee: Sharp Kabushiki Kaisha, Osaka, Japan

[21] Appl. No.: 138,749

[22] Filed: Apr. 9, 1980

[51] Int. Cl.[3] ..... H05B 6/68

[52] U.S. Cl. ..... 219/10.55 B; 219/10.55 R; 219/400; 126/21 R

[58] Field of Search ..... 219/10.55 R, 10.55 B, 219/10.55 C, 10.55 F, 10.55 M, 400, 398; 126/21 A, 21 R

[56] References Cited

U.S. PATENT DOCUMENTS 4,123,643 10/1978 Burke ..... 219/10.55 R
4,308,444 12/1981 Takagi et al. ..... 219/10.55 R

FOREIGN PATENT DOCUMENTS 2922003 12/1979 Fed. Rep. of Germany ... 219/10.55 B
49-34440 3/1974 Japan ..... 219/10.55 B

*Primary Examiner*—Roy N. Envall, Jr.
*Assistant Examiner*—Philip H. Leung
*Attorney, Agent, or Firm*—Birch, Stewart, Kolasch and Birch

[57] ABSTRACT

A combined microwave and electric heating oven including a damper mechanism for selectively and automatically introducing a forced air flow into an oven cavity. A timer is provided for determining a microwave cooking period, wherein a magnetron is energized to perform the microwave cooking operation. The damper mechanism is associated with the timer so that the damper is placed in a first condition wherein the forced air flow is automatically introduced into the oven cavity, when the timer is wound up to select a preferred microwave cooking period. When the preselected time period has been counted by the timer, the microwave generation is terminated, and the damper is placed in a second condition wherein the forced air flow is automatically never introduced into the oven cavity. The damper is placed in the second condition when the electric heating cooking is performed, whereby the interior of the oven cavity is maintained at a high temperature.

13 Claims, 5 Drawing Figures

DAMPER ACTIVATION IN A COMBINED MICROWAVE AND ELECTRIC HEATING OVEN

BACKGROUND AND SUMMARY OF THE INVENTION

The present invention relates to a combined microwave and electric heating oven and, more particularly, to a damper activating mechanism in a combined microwave and electric heating oven.

A combined microwave and electric heating oven has been developed, which includes a microwave generating source for microwave cooking purposes and an electric heater for performing electric heat cooking. In the microwave cooking operation, it is required to introduce an air flow into an oven cavity for recirculation purposes. In contrast thereto, in the electric heating cooking operation, the fresh air flow must not be introduced into the oven cavity in order to maintain the interior of the oven cavity at a high temperature. However, in the electric heating cooking operation, the air flow is required outside of the oven cavity for protecting the mirowave generation source from the high temperature.

On the other hand, to enhance the cooking efficiency, it is desirable that the microwave cooking is first performed and then the electric heating cooking is performed immediately after completion of the microwave cooking operation.

Accordingly, an object of the present invention is to provide a novel damper mechanism in a combined microwave and electric heating oven.

Another object of the present invention is to provide an automatic damper activating mechanism associated with a cooking timer in a combined microwave and electric heating oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects pursuant to an embodiment of the present invention, a blower fan system is provided for creating a forced air flow for cooling a microwave generation source. The blower fan system is continuously energized both in the microwave cooking operation mode and the electric heating cooking operation mode. A damper mechanism is provided for selectively introducing the forced air flow into an oven cavity.

In a preferred form, a microwave cooking operation control timer mechanism is associated with the damper mechanism so that the damper mechanism is placed in a first position, wherein the forced air flow is introduced into the oven cavity, when the microwave cooking operation is performed, and the damper mechanism is placed in a second position, wherein the forced air flow is not introduced into the oven cavity, when the microwave cooking operation control timer mechanism counts up a preselected time period to complete the microwave cooking operation. The damper mechanism is placed in the second position when the electric heating cooking operation is performed.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
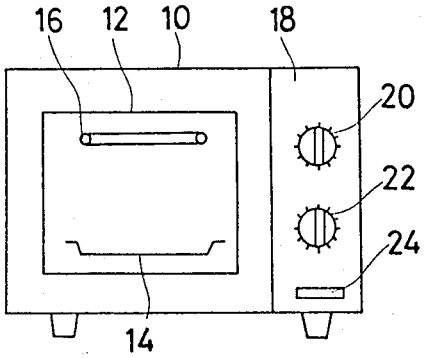
FIG. 1 is a front view of an embodiment of a combined microwave and electric heating oven of the present invention.
Figure 2:
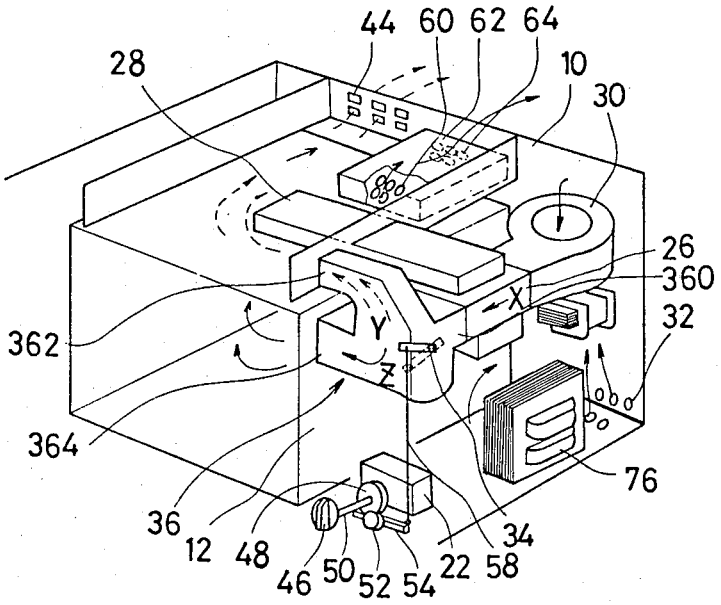
FIG. 2 is a perspective view of the combined microwave and electric heating oven of FIG. 1, wherein an outer casing is removed.

FIGS. 1 and 2 schematically show an embodiment of a combined microwave and electric heating oven of the present invention.

The combined microwave and electric heating oven of the present invention mainly comprises a casing 10, and an oven wall 12 for defining an oven cavity. A tray 14 is removably disposed at the bottom of the oven cavity for supporting foodstuff to be cooked, and an electric heater 16 is disposed at an upper section of the oven cavity for performing the electric heating cooking operation. The combined microwave and electric heating oven further comprises a control panel 18, at which a first timer 20 for determining a cooking time period in an electric heating cooking mode, a second timer 22 for determining a cooking time period in a microwave cooking mode, and a cook start switch 24 are provided.

A magnetron 26 is secured to the side wall 12 of the oven cavity. The microwave energy generated by the magnetron 26 is introduced into the oven cavity via a waveguide 28. A blower fan 30 is provided for introducing fresh air through air inlet openings 32 and developing a forced air flow. The thus created forced air flow is directed to the magnetron 26 for cooking purposes. Moreover, the thus created forced air flow is selectively introduced into the oven cavity via a damper mechanism 34 and an air duct 36. The damper mechanism 34 is associated with the second timer 22 so that the forced air flow is introduced into the oven cavity only when the microwave cooking operation is performed.

More specifically, the air duct 36 includes one inlet 360 for introducing the forced air flow (X), and two outlets 362 and 364 for selectively developing the forced air flow (Y) and (Z).

Figure 3:
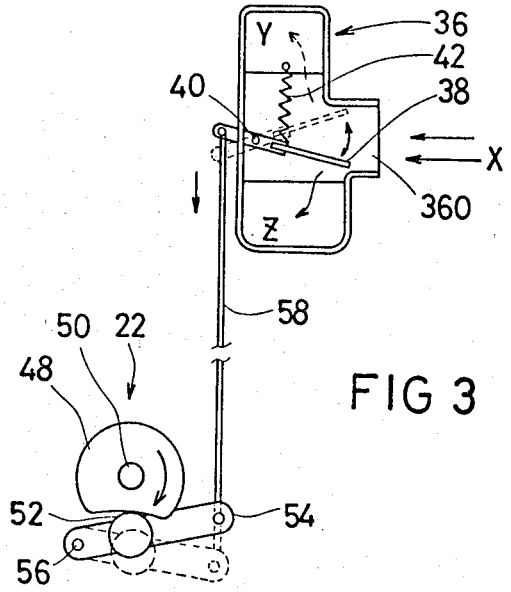
FIG. 3 is a front view of an embodiment of a damper mechanism included in the combined microwave and electric heating oven of FIG. 1.

FIG. 3 shows relationships between the second timer 22 and the damper mechanism 34. Like elements corresponding to those of FIG. 2 are indicated by like numerals.

The damper mechanism 34 includes a damper plate 38 disposed in the air duct 36. The damper plate 38 is rotatably secured to a shaft 40, and biased by a spring 42 to a position shown by the solid line in FIG. 3. That is, in a normal condition, the forced air flow (X) introduced through the inlet 360 is directed to the outlet 362 to create the forced air flow (Y). The forced air flow (Y) is passed through a gap formed between the casing 10 and the oven wall 12, and exhausted through openings 44 formed in the rear wall of the casing 10 (see FIG. 2). Accordingly, the air flow is never introduced into the oven cavity in the normal condition.

When the second timer 22 is wound up to a desired level through the use of a timer knob 46, a cam 48 fixed to a timer shaft 50 is rotated in the clockwise direction, thereby depressing a roller 52 downward. The roller 52 is integrally fixed to a roller lever 54 which is rotatably supported by a shaft 56. Accordingly, when the second timer 22 is wound up to a desired level in order to select a desired cooking time period in the microwave cooking mode, the roller lever 54 is placed in a condition shown by the broken line in FIG. 3. Therefore, the damper plate 38 is placed in a condition shown by the broken line in FIG. 3 via a rod 58. Under these conditions, the forced air flow (X) introduced through the inlet 360 is directed to the outlet 364 to create the forced air flow (Z).

The thus directed forced air flow (Z) is introduced into the oven cavity for recirculation purposes, and exhausted through exhaustion openings 60 formed in the upper oven wall 12, an exhaustion duct 62 secured to the upper oven wall 12, and exhaustion openings 64 formed in the rear wall of the casing 10 (see FIG. 2). That is, the forced air flow (Z) is introduced into the oven cavity when the microwave cooking is performed. When the microwave cooking is completed after a lapse of a time period selected by the second timer 22, the damper plate 38 is returned to the normal position by the spring 42, thereby preventing the forces air from flowing into the oven cavity.

Figure 4:
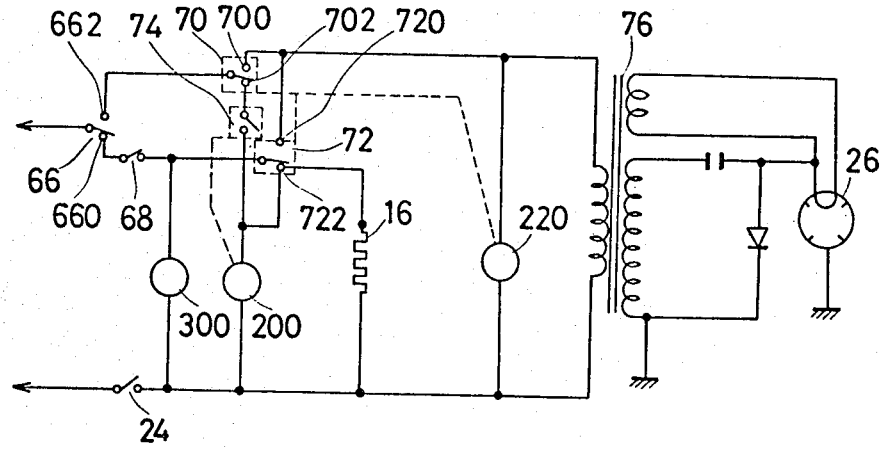
FIG. 4 is a schematic circuit diagram of the combined microwave and electric heating oven of FIG. 1.

FIG. 4 schematically shows a circuit construction of the combined microwave and electric heating oven of the present invention. Like elements corresponding to those of FIGS. 1 and 2 are indicated by like numerals.

A latch switch 66 is associated with an oven door in such a manner that a movable contact of the latch switch 66 is connected to a first terminal 660 when the oven door is opened, and to a second terminal 662 when the oven door is closed. A safe switch 68 is also associated with the oven door so that the safe switch 68 is closed when the oven door is closed. Timer switches 70 and 72 are associated with the second timer 22 in such a manner that movable contacts thereof are connected to first terminals 700 and 720, respectively, when the second timer 22 is wound up. Another timer switch 74 is associated with the first timer 20 so that the timer switch 74 is closed when the first timer 20 is wound up. The first timer 20 includes a timer motor 200 for controlling the cooking time period in the electric heating mode, whereby the timer switch 74 is opened when the preselected time period has been counted by the timer motor 200. The second timer 22 includes another timer motor 220 for controlling the cooking time period in the microwave cooking mode, whereby the movable contacts of the timer switches 70 and 72 are connected to second terminals 702 and 722, respectively, when the preselected time period has been counted by the timer motor 220. FIG. 4 shows the initial condition wherein neither the first timer 20 nor the second timer 22 is wound up.

The control circuit of FIG. 4 further comprises a transformer 76 for supplying power to the magnetron 26, and a blower motor 300 for activating the blower fan 30. Now assume that it is desired to cook a piece of roast beef. It is desirable that microwave cooking is first performed and, then, electric heating cooking is performed. The second timer 22 is wound up to select a desired cooking time period in the microwave cooking mode, and the first timer 20 is wound up to select a desired cooking time period in the electric heating cooking mode. After disposing the meat within the oven cavity, the oven door is tightly closed to connect the movable contact of the latch switch 66 to the second terminal 662, and to close the safe switch 68. Under these conditions, when the cook start switch 24 is closed, the transformer 76 and the timer motor 220 receive the power supply through the first terminal 700 of the timer switch 70. And, the blower motor 300 is activated through the first terminal 720 of the timer switch 72. In this way, microwave cooking is first performed.

While the microwave cooking is performed, the damper plate 38 is placed in the condition shown by the broken line in FIG. 3, whereby the forced air flow (Z) is introduced into the oven cavity for recirculation purposes.

When the microwave cooking has been conducted for a predetermined period of time selected by the second timer 22, the movable contacts of the timer switches 70 and 72 are connected to the second terminals 702 and 722, respectively, to terminate the microwave generation. At the same time, the damper plate 38 is returned to the normal position by the spring 42 to prevent the introduction of the forced air flow into the oven cavity.

Consequently, the electric heater 16 and the timer motor 200 receive the power supply through the second terminal 702 of the timer switch 70 and the timer switch 74. And, the blower motor 300 is activated through the second terminal 722 of the timer switch 72. More specifically, the electric heating cooking operation is automatically started immediately after completion of the microwave cooking operation. It will be clear that, while the electric heating cooking operation is conducted, the forced air flow is not introduced into the oven cavity in order to maintain the inside of the oven cavity at a high temperature. However, the outside of the oven cavity is cooled by the forced air flow (X) and (Y).

When the electric heating cooking has been conducted for a predetermined period of time selected by the first timer 20, the timer switch 74 is switched off to complete the series of cooking operation.

Figure 5:
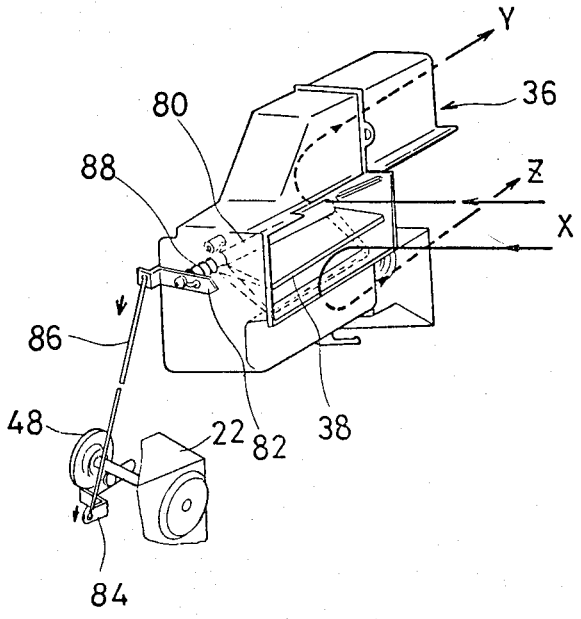
FIG. 5 is a perspective view of another embodiment of the damper mechanism included in the combined microwave and electric heating oven of FIG. 1.

FIG. 5 shows another example of the damper mechanism. Like elements corresponding to those of FIG. 3 are indicated by like numerals.

The damper plate 38 is disposed in the air duct 36 and rotatably supported by a shaft 80. A damper lever 82 is secured to one end of the shaft 80 to rotate around the shaft 80, whereby the damper plate 38 rotates in unison with the damper lever 82. The damper lever 82 is associated with a roller arm 84 through a communication rod 86. When the second timer 22 is wound up, the communication rod 86 is pulled in a direction shown by an arrow in FIG. 5 due to the rotation of the cam 48. Accordingly, the damper plate 38 is placed in the condition shown by the solid line in FIG. 5 in order to introduce the forced air flow (Z) into the oven cavity. A spring 88 biases the damper plate 38 toward the normal position shown by the broken line in FIG. 5, wherein the forced air flow is never introduced into the oven cavity.

In case where the electric heating cooking is desired to be first conducted and, then, the microwave cooking should be performed, the control circuit of FIG. 4 should be modified to assign the priority to the electric heating cooking operation. In this case, the damper mechanism should be associated with the timer for determining the cooking time period in the electric heating cooking mode. And, the damper mechanism should be constructed so that in its normal condition the forced air flow is introduced into the oven cavity, and, when the electric heating timer is wound up, the damper plate is placed in a condition wherein the forced air flow is never introduced into the oven cavity.

Although in the foregoing embodiments the mechanical timer is employed, the present invention can be applied to a combined microwave and electric heating oven including a digitally constructed timer system. In this case, a plunger mechanism is preferably associated with the damper mechanism so that the plunger mechanism is activated when the microwave cooking operation is performed in order to place the damper mechanism in a first condition wherein the forced air flow is introduced into the oven cavity.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined microwave and electric heating oven comprising:
- an oven wall defining an oven cavity therein;
- microwave generating means disposed at the outside of the oven cavity for performing a microwave cooking operation;
- electric heater means for performing an electric heating cooking operation;
- blower fan means operatively associated with the microwave generating means for creating a forced air flow for cooling said microwave generating means;
- air flow guide means for directing said forced air flow toward said oven cavity;
- damper means disposed in said air flow guide means, said damper means selectively taking a first position wherein said forced air flow is introduced into said oven cavity and a second position wherein said forced air flow is not introduced into said cavity;
- first cooking time period determination means for determining a period of microwave cooking wherein said microwave generating means is energized; and
- drive means operatively associated with said first cooking time period determination means for driving said damper means, said damper means being positioned in said first position when said microwave generating means is energized, and said damper being positioned in said second position when said microwave generating means is de-energized and said electric heater means is energized.

2. The combined microwave and electric heating oven of claim 1, wherein said damper means is placed in said second position when said microwave generating means is not energized.

3. The combined microwave and electric heating oven of claim 1 or 2, further comprising:
- second cooking time period determination means for determining a period of electric heating cooking wherein said electric heater means is energized.

4. The combined microwave and electric heating oven of claim 3, further comprising:
- first control means for assigning the priority to the microwave cooking, whereby the microwave generating means is first energized for said period determined by said first cooking time period determination means and, then, the electric heater means is energized for said period determined by said second cooking time period determination means.

5. The combined microwave and electric heating oven of claim 4, further comprising:
- second control means for energizing said blower fan means when either said microwave generating means or said electric heater means is energized.

6. A combined microwave and electric heating oven comprising:
- an oven wall defining an oven cavity therein; microwave generating means disposed at the outside of the oven cavity for performing the microwave cooking operation;
- electric heater means for performing the electric heating cooking operation;
- blower fan means for creating a forced air flow for cooling said microwave generating means;
- air flow guide means for directing said forced air flow toward said oven cavity;
- damper means disposed in said air flow guide means, said damper means selectively taking a first position wherein said forced air flow is introduced into said oven cavity and a second position wherein said forced air flow is not introduced into said oven cavity;
- timer means for determining a first time period at which said microwave generating means is energized, and a second time period at which said electric heater means is energized;
- first drive means associated with said timer means for energizing said blower fan means at said first time period and said second time period; and
- second drive means associated with said timer means for placing said damper means in said first position at said first time period.

7. A combined microwave and electric heating oven comprising:
- an oven wall defining an oven cavity therein,
- microwave generating means disposed at the outside of the oven cavity for introducing microwave energy into the oven cavity for performing a microwave cooking operation;
- electric heater means disposed in said oven cavity for performing an electric heating cooking operation;
- blower fan means operatively associated with the microwave generating means for creating a forced air flow for cooling the microwave generating means;
- air flow guide means communicating with the oven cavity and a zone surrounding said oven cavity, said air flow guide means directing said forced air flow toward said oven cavity and the zone surrounding said oven cavity,
- damper means disposed in said air flow guide means, said damper means being adapted to selectively take a first position wherein said forced air flow is introduced into said oven cavity or a second position wherein said forced air flow is introduced into said zone surrounding the oven cavity, first cooking time period determination means for determining a period of microwave cooking wherein said microwave generating means is energized; and drive means operatively associated with said first cooking time period determination means for driving said damper means, said damper means being positioned in said first position when said microwave generating means is energized and said damper means being positioned in said second position when said microwave generating means is de-energized and said electric heater means is energized.

8. The combined microwave and electric heating oven of claim 7 wherein the electric heater means is disposed in the upper portion of the oven cavity.

9. The combined microwave and electric heating oven of claim 8 wherein the zone surrounding the oven cavity is a gap formed between the oven wall and the casing surrounding the oven wall.

10. The combined microwave and electric heating oven of claim 9 wherein vent means are provided in the casing for removing the forced air flow from the zone surrounding the oven cavity.

11. The combined microwave and electric heating oven of claim 7 wherein an exhaust duct is provided for removing the forced air flow from the oven cavity.

12. The combined microwave and electric heating oven of claim 10 wherein in a normal operating condition the damper means is spring biased to channel the forced air flow into the zone surrounding the oven cavity and wherein, in the microwave cooking operation the damper means is automatically rotated against the bias to thereby channel the forced air flow into the oven cavity.

13. The combined microwave and electric heating oven of claim 7 wherein the time period determination means includes a first timer for determining a cooking time period in the electric heating cooking mode and a second timer for determining a cooking time period in the microwave cooking mode.

* * * * *